US008509643B2

(12) United States Patent
Furuyama

(10) Patent No.: US 8,509,643 B2
(45) **Date of Patent: *Aug. 13, 2013**

(54) FIXING APPARATUS, IMAGE FORMING APPARATUS AND FIXING METHOD

(75) Inventor: Noboru Furuyama, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/472,663

(22) Filed: May 16, 2012

(65) Prior Publication Data

US 2012/0224877 A1 Sep. 6, 2012

Related U.S. Application Data

(62) Division of application No. 12/175,571, filed on Jul. 18, 2008, now Pat. No. 8,204,397, and a division of application No. 11/452,635, filed on Jun. 14, 2006, now Pat. No. 7,414,640.

(51) Int. Cl.
*G03G 15/20* (2006.01)

(52) U.S. Cl.
USPC ..... 399/69; 399/122; 399/320; 399/328; 399/329; 399/330; 399/331; 399/334

(58) Field of Classification Search
USPC ..... 399/67–69, 122, 320, 328–331, 334; 347/155–156, 212
See application file for complete search history.

(56) References Cited

U.S. PATENT DOCUMENTS

| | | | | |
|---|---|---|---|---|
| 5,671,462 | A | 9/1997 | Toyohara et al. | |
| 5,681,494 | A * | 10/1997 | Suzuki et al. | 219/497 |
| 5,872,620 | A | 2/1999 | Wakamiya | |
| 6,651,026 | B2 | 11/2003 | Yamauchi et al. | |
| 7,304,273 | B2 | 12/2007 | Kinouchi et al. | |
| 7,414,640 | B2 | 8/2008 | Furuyama | |

(Continued)

FOREIGN PATENT DOCUMENTS

| | | |
|---|---|---|
| JP | 07-244439 | 9/1995 |
| JP | 08-234617 | 9/1996 |
| JP | 10-301439 | 11/1998 |

OTHER PUBLICATIONS

Office Action for U.S. Appl. No. 12/175,571 mailed on Oct. 20, 2009.

(Continued)

*Primary Examiner* — David Gray
*Assistant Examiner* — Geoffrey Evans
(74) *Attorney, Agent, or Firm* — Turocy & Watson, LLP

(57) ABSTRACT

A fixing apparatus includes a heating roller, a fixing roller, a fixing belt that is wound around the heating roller and the fixing roller and circulates between the heating roller and the fixing roller, a pressing roller to press the fixing roller through the fixing belt, a first heater that is included in the heating roller and mainly heats a center part of the heating roller, a second heater that is included in the heating roller and mainly heats a peripheral part of the heating roller, and a temperature control unit to control a temperature of the heating roller by an on/off control of the first heater and the second heater, and the temperature control unit performs the on/off control in which when one of the first heater and the second heater is turned on, the other is turned off.

20 Claims, 7 Drawing Sheets

(56) References Cited

U.S. PATENT DOCUMENTS

| | | | | |
|---|---|---|---|---|
| 7,664,416 | B2 | 2/2010 | Watabe | |
| 7,877,027 | B2 | 1/2011 | Furuyama | |
| 7,949,274 | B2 | 5/2011 | Furuyama | |
| 8,204,397 | B2 * | 6/2012 | Furuyama | 399/69 |
| 8,218,984 | B2 * | 7/2012 | Ota | 399/33 |
| 8,224,203 | B2 * | 7/2012 | Miyazaki | 399/69 |
| 8,238,774 | B2 * | 8/2012 | Takada | 399/69 |
| 2002/0018663 | A1 | 2/2002 | Furukawa et al. | |
| 2005/0008383 | A1 * | 1/2005 | Tanaka et al. | 399/67 |
| 2005/0286919 | A1 | 12/2005 | Matsumoto | |
| 2009/0257769 | A1 * | 10/2009 | Miyazaki | 399/69 |
| 2012/0263487 | A1 * | 10/2012 | Itaya | 399/68 |

OTHER PUBLICATIONS

Office Action for U.S. Appl. No. 12/175,571 mailed on Nov. 17, 2009.

* cited by examiner

FIXING APPARATUS, IMAGE FORMING APPARATUS AND FIXING METHOD

CROSS-REFERENCE TO RELATED APPLICATIONS

This application claims the benefit of priority from and is a Division of application Ser. No. 12/175,571 filed on Jul. 18, 2008, which is a Division of application Ser. No. 11/452,635 filed on Jun. 14, 2006, the entire contents of both of which are incorporated herein by reference.

BACKGROUND OF THE INVENTION

1. Technical Field of the Invention

The present invention relates to a fixing apparatus, an image forming apparatus and a fixing method, and particularly to a fixing apparatus for fixing a toner image transferred on a recording sheet or the like, an image forming apparatus and a fixing method.

2. Related Art

In an image forming apparatus, such as a copying machine or a printer, adopting an electrophotographic system, a fixing apparatus for fixing a toner image transferred on a recording sheet is used. As one of modes of the fixing apparatus, there is a heat-pressure fixing apparatus of a fixing belt system.

In this fixing apparatus, an endless fixing belt is wound around a heating roller and a fixing roller, and a pressing roller adjacent to the fixing roller and the fixing roller are brought into press contact with each other through the fixing belt.

A heater is disposed inside the heating roller, and the fixing belt is heated when it moves on the heating roller. The heated fixing belt reaches a nip part (gap between two rollers) formed of the fixing roller and the pressing roller and comes in contact with a recording sheet passing through the nip part, so that an unfixed toner image on the recording sheet is fixed by the heat and pressure.

In order to uniformly perform the fixation of the toner image to the recording sheet, it is important to uniformly keep the temperature of the heating roller within a suitable range. Thus, various techniques relating to heater control inside the heating roller have been conventionally proposed.

For example, JP-A-7-244439 discloses a technique in which plural heaters are provided in a heating roller and the on and off of each of the heaters is independently controlled.

Besides, JP-A-10-301439 discloses a technique in which the periods and ratios of the on and off of plural heaters are selected from a specified range according to the paper quality or temperature and humidity, and the user can suitably change them.

Besides, JP-A-8-234617 and U.S. Pat. No. 5,872,620 discloses a technique in which a main heater to heat the center part of a heating roller and a sub-heater to heat both ends are provided, fine timing of the on and off of these two heaters is controlled, and a reduction in life of a switching element to perform the on/off control can be suppressed.

The above respective techniques are common to each other in that plural heaters are provided in the heating roller, and the temperature control is performed by controlling the period and ratio of the on and off of each heater.

In the case where the on/off control of the plural heaters is performed, there is a possibility that the electric power consumption is significantly changed. For example, in the case where the on periods of all the heaters overlap each other, the electric power consumption becomes very large, whereas in the case where the off periods of all the heaters overlap each other, the electric power consumption approaches zero. When a variation of the electric power consumption is large, a load to a power supply circuit becomes large, and further, in order to ensure the performance also at the time when the electric power consumption is largest (in the case where the on periods of all the heaters overlap each other), a large scale power supply circuit must be provided.

Besides, although the above respective techniques are techniques to equalize the temperature of the heating roller mainly in the axial direction, in the fixing apparatus of the fixing belt system, it is important to equalize the temperature not only in the axial direction of the heating roller but also in the movement direction of the fixing belt.

SUMMARY OF THE INVENTION

The invention has been made in view of the above circumstances, and it is an object to provide a fixing apparatus in which in the fixing apparatus of a fixing belt system using plural heaters to perform a temperature control of a heating roller, a variation in electric power consumption is suppressed, equalization of temperature can be ensured not only in the axial direction of the heating roller but also in the movement direction of the fixing belt, and uniform fixation without uneven temperature can be performed to a recording sheet, an image forming apparatus using the fixing apparatus, and a fixing method.

In order to achieve the object, a fixing apparatus according to an aspect of the invention includes a heating roller, a fixing roller, a fixing belt that is wound around the heating roller and the fixing roller and circulates between the heating roller and the fixing roller, a pressing roller to press the fixing roller through the fixing belt, a first heater that is included in the heating roller and mainly heats a center part of the heating roller, a second heater that is included in the heating roller and mainly heats a peripheral part of the heating roller, and a temperature control unit to control a temperature of the heating roller by an on/off control of the first heater and the second heater, and wherein the temperature control unit performs the on/off control in which when one of the first heater and the second heater is turned on, the other is turned off.

Besides, in order to achieve the object, an image forming apparatus according to an aspect of the invention is an image forming apparatus including a fixing apparatus to perform a temperature control by using a heater, and the fixing apparatus includes a heating roller, a fixing roller, a fixing belt that is wound around the heating roller and the fixing roller and circulates between the heating roller and the fixing roller, a pressing roller to press the fixing roller through the fixing belt, a first heater that is included in the heating roller and mainly heats a center part of the heating roller, a second heater that is included in the heating roller and mainly heats a peripheral part of the heating roller, and a temperature control unit to control a temperature of the heating roller by an on/off control of the first heater and the second heater, and wherein the temperature control unit performs the on/off control in which when one of the first heater and the second heater is turned on, the other is turned off.

Besides, in order to achieve the object, a fixing method according to an aspect of the invention includes the steps of circulating a fixing belt wound around a heating roller and a fixing roller between the heating roller and the fixing roller, pressing the fixing roller by a pressing roller through the fixing belt, heating mainly a center part of the heating roller by a first heater included in the heating roller, heating mainly a peripheral part of the heating roller by a second heater included in the heating roller, and controlling a temperature of the heating roller by an on/off control of the first heater and the second heater, and wherein in the step of controlling the temperature, the on/off control is performed in which when one of the first heater and the second heater is turned on, the other is turned off.

BRIEF DESCRIPTION OF THE DRAWINGS

In the accompanying drawings.

DETAILED DESCRIPTION OF THE PREFERRED EMBODIMENTS

Embodiments of a fixing apparatus, an image forming apparatus and a fixing method of the invention will be described with reference to the accompanying drawings.

(1) Structure

Figure 1:
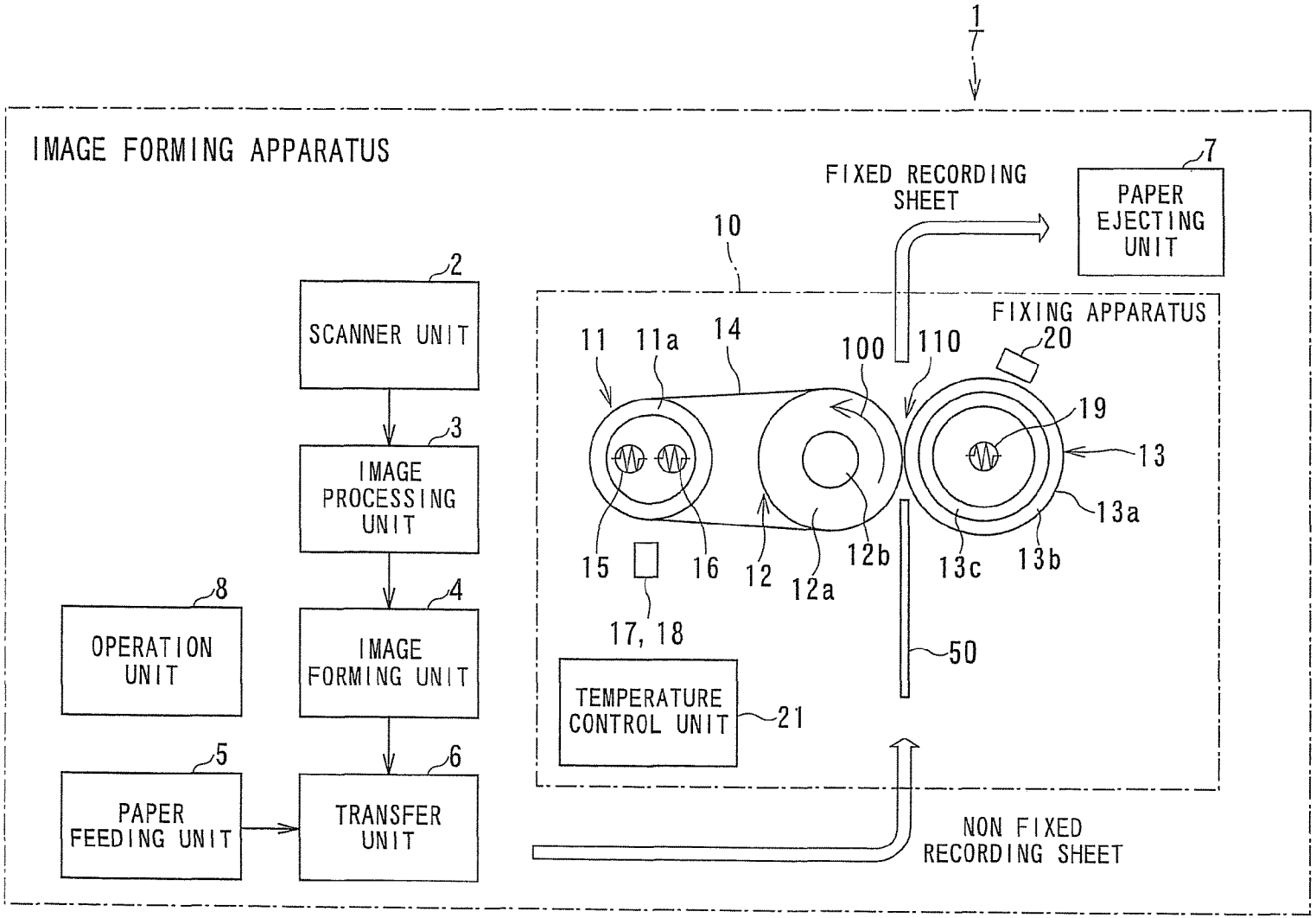
FIG. 1 is a view showing a structural example of an image forming apparatus and a fixing apparatus according to an embodiment of the invention.

FIG. 1 is a view showing a structural example of a fixing apparatus 10 of an embodiment of the invention and an image forming apparatus 1 including the fixing apparatus 10.

The image forming apparatus 1 includes, for example, a scanner unit 2, an image processing unit 3, an image forming unit 4, a paper feeding unit 5, a transfer unit 6, the fixing apparatus 10, a paper ejecting unit 7 and an operation unit 8.

In the scanner unit 2, reflected light from a document is read by, for example, a CCD sensor, and is converted into image data to be read.

The image processing unit 3 performs various image processings, such as a color conversion processing, a filtering processing and a gradation processing, on the read image data.

In the image forming unit 4, for example, a pulse width modulation is performed according to the intensity of the image data subjected to the image processing, and an electrostatic latent image is formed on a photoconductive drum by using a laser beam or the like. Further, in the image forming unit 4, the electrostatic latent image is developed with toner and a toner image is formed on the photoconductive drum.

In the transfer unit 6, the toner image on the photoconductive drum is transferred onto a recording sheet transported from the paper feeding unit 5. The transfer from the photoconductive drum to the recording sheet may be a mode in which it is directly performed, or a mode in which the toner image of the photoconductive drum is once intermediately transferred onto an intermediate transfer body and is again transferred from the intermediate transfer body to the recording sheet.

The recording sheet (unfixed recording sheet) on which the toner image has been transferred is outputted from the transfer unit 6 to the fixing apparatus 10. The fixed recording sheet which has been fixed in the fixing apparatus 10 is outputted from the paper ejecting unit 7 to the outside.

The operation unit 8 includes an operation panel provided with, for example, a liquid crystal display or a touch panel, suitable keys and the like.

Although FIG. 1 is the view showing the structural example of the image forming apparatus 1 as a copying machine, the image forming apparatus 1 can be made also to function as a printer. In this case, the mode is such that image data created by an external apparatus such as a personal computer is inputted to the image processing unit 3 through an external interface (not shown).

Next, the detail structure of the fixing apparatus 10 will be described.

The fixing apparatus 10 includes a heating roller 11, a fixing roller 12, a pressing roller 13, and a fixing belt 14.

The fixing belt 14 is an endless belt wound around the heating roller 11 and the fixing roller 12, and circulates between the heating roller 11 and the fixing roller 12.

The pressing roller 13 is brought into press contact with the fixing roller 12 through the fixing belt 14. An unfixed recording sheet 50 transported from the transfer unit 6 receives the heat and pressure when passing through a contact part (nip part 110) between the pressing roller 13 and the fixing belt 14, and the unfixed toner image is fixed to the recording sheet 50.

The fixing belt 14 has a structure in which a thin seamless belt molded of metal such as nickel or heat-resistant resin such as polyimide is made a base material, and its surface is coated with a heat-resistant rubber, such as silicone rubber impregnated with oil or fluorine rubber, or a fluorine resin, or a structure in which silicone rubber is coated with a heat-resistant high mold-release resin such as a PFA (PerFluoro alkoxyl Alkane) tube.

Incidentally, in this embodiment, the structure is such that a heat-resistant elastic layer of coated silicone rubber with a thickness of about 200 μm is provided on an outer peripheral surface of a thin seamless belt made of electroformed nickel of about 37 μm, and further, its outer peripheral surface is coated with a tube with a thickness of about 30 μm. The heating roller 11 to heat the fixing belt 14 and to apply tension to the fixing belt 14, and the fixing roller 12 to drive the fixing belt 14 and to form a fixing area between itself and the pressing roller 13 are disposed inside the fixing belt 14.

The heating roller 11 of this embodiment has a diameter of about 30 mm, and is constructed such that a core bar ha made of an aluminum pipe with a thickness of about 1 mm is coated with a cover layer of PTFE (Poly TetraFluoro Ethylene) with a thickness of about 20 μm.

Two axial heater lamps 15 and 16 (first heater 15, second heater 16) as heat sources are disposed inside the heating roller 11. The electric power consumptions of the heater lamps 15 and 16 are almost equal to each other, and each of them is about 600 W, however, light distributions in the axial direction (that is, the axial direction of the heating roller 11) are different from each other.

Figure 2A:
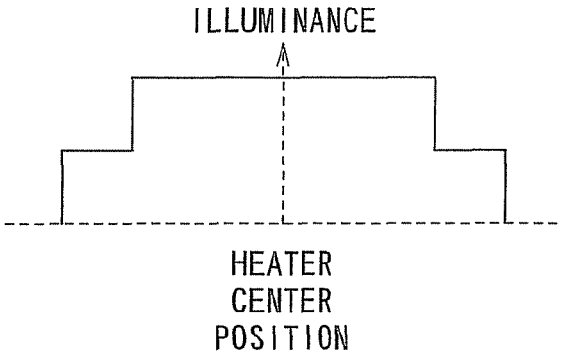
FIGS. 2A and 2B are views conceptually showing light distributions of two heater lamps included in a heating roller of the fixing apparatus.

FIG. 2A is a view schematically showing the light distribution of the heater lamp 15, and the distribution is such that illuminance at the center part is high and illuminance at the peripheral part is low.

Figure 2B:
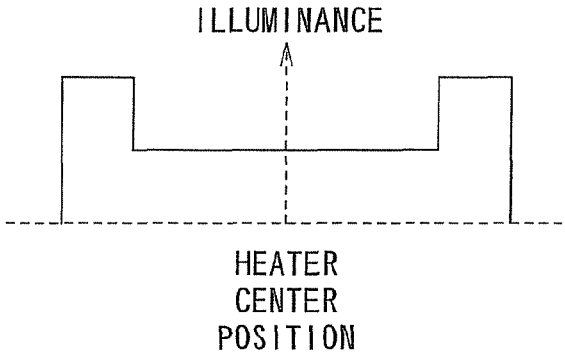

FIG. 2B is a view schematically showing the light distribution of the heater lamp 16, and contrary to the heater lamp 15, the distribution is such that the illuminance at the peripheral part is high, and the illuminance at the center part is low. Hereinafter, for convenience of the description, the heater lamp 15 will be referred to as the heater (center part) 15 and the heater lamp 16 will be referred to as the heater (peripheral part) 16.

The fixing roller 12 has such a structure that an outer peripheral surface of a core bar 12*b* having an outer diameter of about 38 mm and a hardness of about 30° (ASKER-C hardness) is coated with a heat-resistant elastic body 12*a* made of silicone sponge with a thickness of about 8 mm. As the heat-resistant elastic body 12*a*, the sponge is preferable from the viewpoint that thermal insulation is high and a nip can be ensured by a low load, however, rubber may be used.

The pressing roller 13 disposed at a position opposite to the fixing roller 12 applies a load of about 350 N by a spring (not shown) to between itself and the fixing roller 12 through the fixing belt 14, and the nip of about 8.5 mm is formed.

The pressing roller 13 is constructed such that an outer peripheral surface of a core bar 13*c* made of an aluminum pipe having an outer diameter of about 40 mm, a hardness of 80° (ASKER-C hardness) and a thickness of 2 mm is coated with a silicone rubber (silicone rubber of 20° in JIS-A hardness) 13*b* having a thickness of about 2 mm, and further, its outer periphery is coated with a PFA tube 13*a* with a thickness of about 30μ. A heater lamp 19 of about 300 W is disposed as a heat source inside the pressing roller 13.

Temperature sensors 17 and 18 are provided in the vicinity of the heating roller 11. The temperature sensors 17 and 18 are thermopiles capable of detecting the temperature in a non-contact manner, and are respectively disposed to be spaced from the fixing belt on the heating roller by about 4 mm.

In these, the temperature sensor 17 is disposed in the vicinity of the center part of the heating roller 11, and will be hereinafter referred to as the temperature sensor (center part) 17 (first sensor). Besides, the temperature sensor 18 is disposed in the peripheral part (one of peripheral parts in the axial direction) of the heating roller 11, and will be hereinafter referred to as the temperature sensor (peripheral part) 18 (second sensor).

The temperature sensor (center part) 17 and the temperature sensor (peripheral part) 18 detect the surface temperature of the fixing belt 14 wound around the outer peripheral surface of the heating roller 11, and control the heater (center part) 15 and the heater (peripheral part) 16. The temperature sensor (center part) 17 and the temperature sensor (peripheral part) 18 may be constructed of non-contact type thermistors. Besides, they may be made contact type thermistors and may be mounted on the surface of the heating roller 11.

On the other hand, the temperature sensor 20 is disposed in the vicinity of the pressing roller 13. The temperature sensor 20 is, for example, a non-contact type thermistor, and in order to control the heater lamp 19 disposed inside the pressing roller 13, it is disposed at a place spaced from the surface of the pressing roller 13 by about 2 mm, and detects the surface temperature of the pressing roller 13.

(2) Operation

First Embodiment

The operation (fixing method) of the fixing apparatus 10 constructed as described above will be described.

In the fixing apparatus 10, the fixing roller 12 is rotated in the direction of an arrow 100 by a drive motor (not shown). With this rotation, the fixing belt 14, the heating roller 11 and the pressing roller 13 are also driven and rotated. The fixing belt 14 is heated in a contact area between itself and the heating roller 11, and the heated area reaches the nip part 110 constructed of the fixing roller 12 and the pressing roller 13 by the rotation of the fixing belt 14. The unfixed toner transferred on the recording sheet 50 passes through this nip part 110, comes in contact with the fixing belt 14, and is fixed to the recording sheet 50 by heat and pressure.

Figure 3:
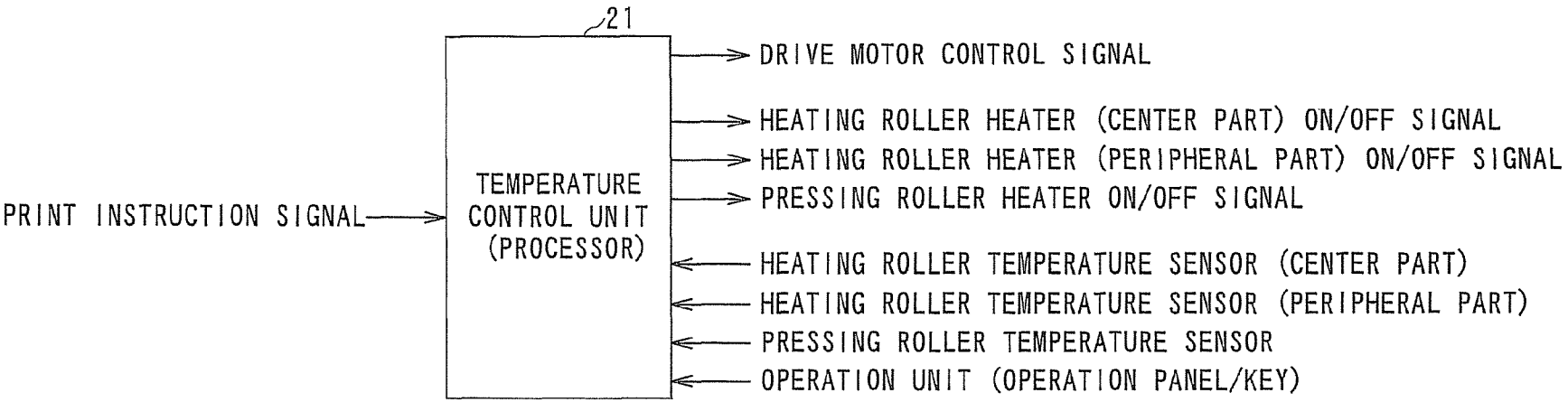
FIG. 3 is a view showing an example of input/output signals of a temperature control unit.

Next, a fixing temperature control will be described. The fixing temperature control is performed by a temperature control unit 21 shown in FIG. 1 and FIG. 3. The temperature control unit 21 includes a processor and the like. The heater (center part) 15 and the heater (peripheral part) 16 disposed inside the heating roller 11, and the heater lamp 19 disposed inside the pressing roller 13 are independently controlled.

First, a turning-on method of the heater (center part) 15 and the heater (peripheral part) 16 disposed inside the heating roller 11 will be described.

When a print instruction signal is inputted, the temperature control unit 21 outputs a drive motor control signal to a drive motor based on the signal, and drives the drive motor.

Besides, the temperature control unit 21 receives signals (temperature information) detected by the temperature sensor (center part) 17 and the temperature sensor (peripheral part) 18, and outputs, based on this temperature information, on/off signals to drive the heater (center part) 15 and the heater (peripheral part) 16.

The heater (center part) 15 is controlled based on the detected temperature of the temperature sensor (center part) 17, and the heater (peripheral part) 16 is controlled based on the detected temperature of the temperature sensor (peripheral part) 18. The temperature sensor (center part) 17 and the temperature sensor (peripheral part) 18 respectively have specified set temperatures. Although the set temperatures can be made different values, in order to equalize the temperature of the heating roller 11 in the axial direction, they are normally the same set temperature.

In this embodiment, four control patterns (pattern 1, 2A, 2B and 3) are provided using a relative relation among the respective temperatures detected by the temperature sensor (center part) 17 and the temperature sensor (peripheral part) 18 and the set temperature, and the heater (center part) 15 and the heater (peripheral part) 16 are on/off controlled.

Hereinafter, the temperature control of this embodiment will be described with reference to FIG. 4. In the lower part of FIG. 4, on/off signals to control the heater (center part) 15 and the heater (peripheral part) 16 are shown. Besides, in the upper part of FIG. 4, the detected temperatures detected by the temperature sensor (center part) 17 and the temperature sensor (peripheral part) 18 and the set temperature are shown.

A pattern 1 is a control pattern in a case where both the detected temperatures of the temperature sensor (center part) 17 and the temperature sensor (peripheral part) 18 are higher than the set temperature. In the pattern 1, both the heater (center part) 15 and the heater (peripheral part) 16 are turned off.

Patterns 2A and 2B are patterns in a case where both the detected temperatures of the temperature sensor (center part) 17 and the temperature sensor (peripheral part) 18 are lower than the set temperature. In this case, the pattern 2A is the control pattern in the case where the temperature detected by the temperature sensor (center part) 17 is higher than the temperature detected by the temperature sensor (peripheral part) 18, whereas the pattern 2B is the control pattern in the case where the temperature detected by the temperature sensor (peripheral part) 18 is higher than the temperature detected by the temperature sensor (center part) 17.

In the patterns 2A and 23, the heater (center part) 15 and the heater (peripheral part) 16 are not simultaneously turned on to heat, and turning on and turning off are alternately repeated.

Figure 4:
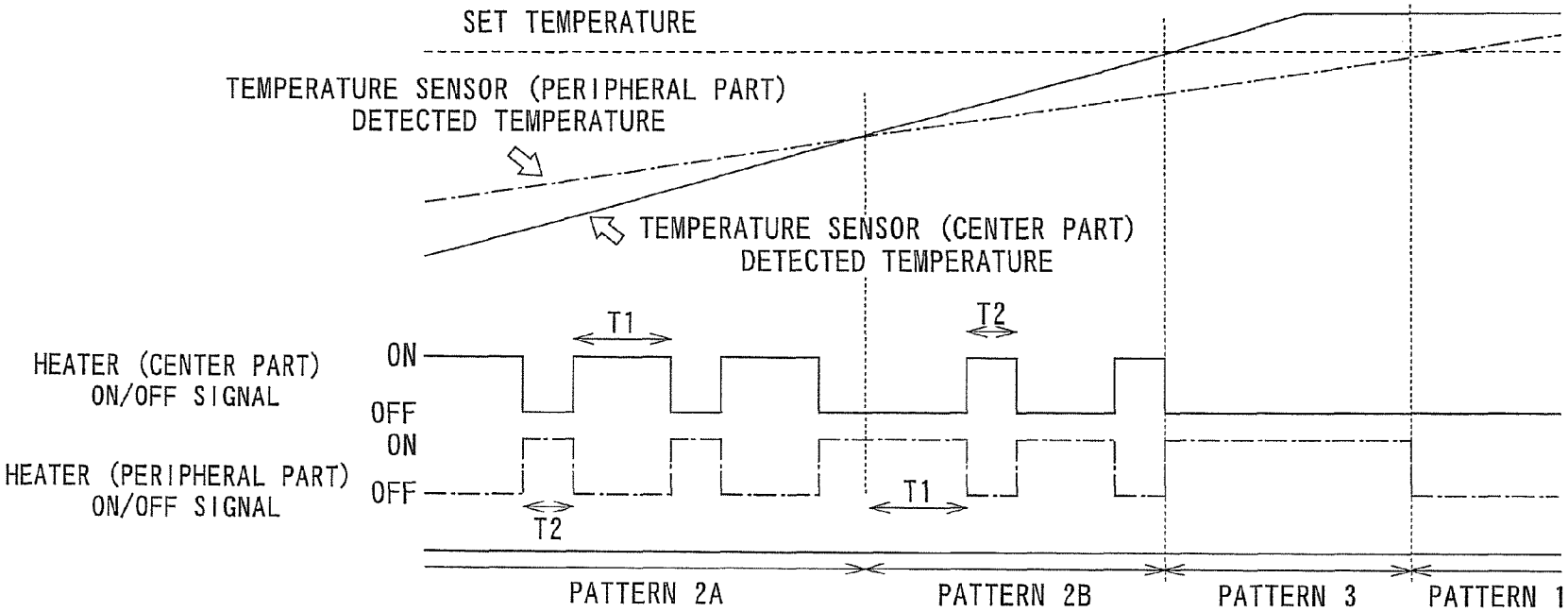
FIG. 4 is a conception explanatory view of a temperature control according to a first embodiment.

Specifically, as shown in FIG. 4, turning-on is alternately repeated at a cycle (T1+T2) as the sum value of a first period T1 and a second period T2 (hereinafter simply referred to as T1 and T2). Here, T1 is set to be a larger value than T2.

In the pattern 2A, the heater (center part) 15 is turned on in the period of T1 and is turned off in the period of T2, and repeats this. On the other hand, the heater (peripheral part) 16 is turned off in the period of T1 and is turned on in the period of T2. Since the period of T1 is longer than the period of T2, the average electric power supplied to the heater (center part) 15 is larger than the average electric power supplied to the heater (peripheral part) 16. Thus, the temperature rising rate of the heater (center part) 15 becomes high as compared with that of the heater (peripheral part) 16, the temperature of the heater (center part) 15, which is low at first, exceeds the temperature of the heater (peripheral part) 16, and a transition is made to the control pattern of the pattern 2B.

In the pattern 2B, the heater (center part) 15 is turned on in the period of T2 and is turned off in the period of T1, and repeats this, whereas the heater (peripheral part) 16 is turned off in the period of T2 and is turned on in the period of T1. As a result, the temperature of the heater (peripheral part) 16, which has a lower temperature, rises at a high temperature rising rate.

When one of the detected temperatures exceeds the set temperature, a transition is made to a pattern 3. In the pattern 3, only the heater corresponding to the sensor of the detected temperature lower than the set temperature is turned on, and the heater corresponding to the sensor of the set temperature or higher is turned off. In the example of FIG. 4, the heater (peripheral part) 16 is turned on and the heater (center part) 15 is turned off.

According to the fixing method (temperature control method) of the first embodiment, when one of the heaters is turned on, the other heater is turned off. Thus, the sum of the electric powers supplied to the two heaters becomes always constant, a variation in the electric power consumption by the temperature control can be suppressed, and a load applied to the power supply system becomes small. Besides, since the electric power consumption is constant, it becomes easy to restrict the power supply system to a necessary minimum scale.

Besides, in the temperature control method of the first embodiment, in the case where the temperature of the heating roller 11 (or the fixing belt 14) in the axial direction is lower than the set temperature in both the center part and the peripheral part, the electric power is supplied to the heater provided in a lower temperature part at a high on-duty ratio (T1/(T1+T2)). Thus, the temperature of the center part and the temperature of the peripheral part rise so as to mutually surpass each other, and in the temperature rising process up to the set temperature, the temperature distribution of the heating roller 11 at the center part and the peripheral part is equalized. As a result, uneven temperature in the axial direction is eliminated in the temperature to fix the recording sheet, and stable fixing becomes possible.

(3) Operation

Second Embodiment

The change of the detected temperature shown in FIG. 4 shows the average (macro) temperature shift, and the temperature of the fixing belt 14 moving on the heating roller 11 is actually changed periodically according to the on/off state of the heater.

For example, with respect to the temperature of the center part of the fixing belt 14, in the pattern 2A, heating is performed in the period T1 and the temperature rises, while in the period T2, since the heater (center part) 15 is turned off, the temperature is lowered by heat radiation. Since the amount of heat reception is larger than the amount of heat radiation, the rising and lowering of temperature is repeated at every on and off time, and the total average temperature rises (see FIG. 6).

The temperature variation due to the on and off of the heater (center part) 15 appears as the uneven temperature of the fixing belt 14 in the movement direction, and the uneven temperature becomes the uneven temperature of the fixing temperature in the transport direction of the recording sheet. When the uneven temperature is large, poor fixation and uneven luster are caused.

The width of the temperature variation in the movement direction of the fixing belt 14 depends on the periods T1 and T2, and as the periods T1 and T2 become short, the width of the temperature variation becomes small, however, they can not be made very small in view of the responsibility of heat transmission.

In this embodiment, as values at which the temperature variation in the movement direction of the fixing belt 14 falls within an allowable range, for example, T1 is made about 3.4 seconds, and T2 is made about 1.6 seconds (the period becomes about 5.0 seconds).

Incidentally, there is a case where the image forming apparatus 1 has plural different process speeds. For example, in the case where a recording sheet thicker than a normal recording sheet is used, in order to ensure a specified fixing temperature, there is a case where the movement speed of the fixing belt 14 is made lower than the normal speed and fixing is performed. This is because in general, as the movement speed of the fixing belt 14 becomes low, the heat which the fixing belt 14 receives from the heating roller 11 becomes large.

Figure 5:
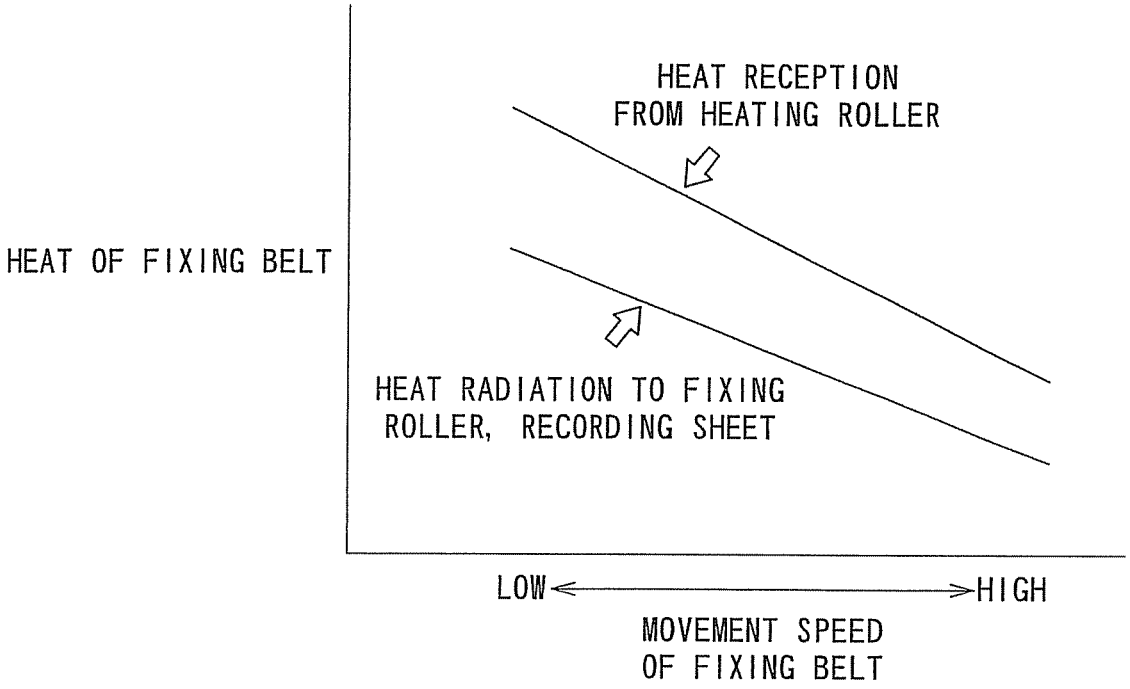
FIG. 5 is a view schematically showing a relation between heat reception and heat radiation of a fixing belt with respect to a movement speed of the fixing belt.

On the other hand, as the movement speed becomes low, the amount of heat radiation also becomes large. FIG. 5 is a view that schematically shows a relation of the heat reception and heat radiation of the fixing belt 14 with respect to the movement speed. In the case where the movement speed of the fixing belt 14 is small, the heat reception from the heating roller 11 becomes large, however, the amount of heat radiation to the fixing roller 12 and the recording sheet 50 also becomes large.

This means that as the movement speed becomes low, the width of the temperature variation due to the on and off of the heater becomes large.

Figure 6:
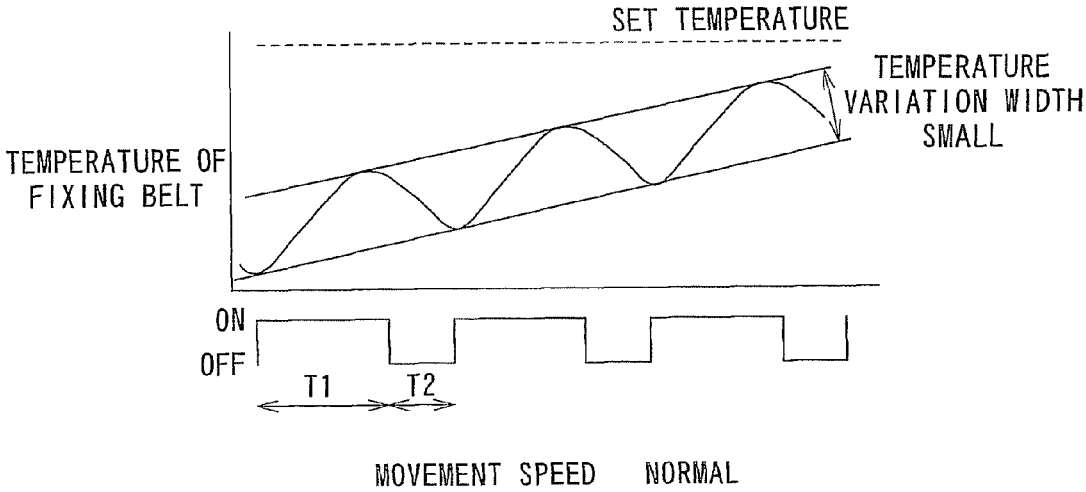
FIG. 6 is a view showing an example of a state of a temperature variation in a case where the movement speed of the fixing belt is normal.

FIG. 6 schematically shows a state of the temperature variation of the fixing belt 14 when it is moved at a normal speed, for example, 150 mm/sec, and in this case, the width of the temperature variation is in the allowable range.

Figure 7:
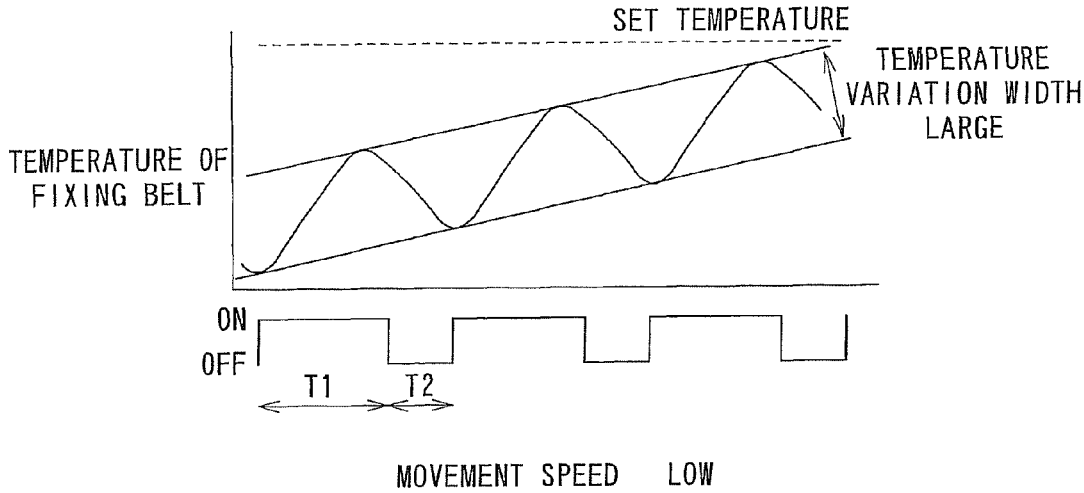
FIG. 7 is a view showing an example of a state of a temperature variation in a case where the movement speed of the fixing belt is lower than the normal speed.

On the other hand, FIG. 7 shows the temperature variation of the fixing belt 14 when it is moved at a low speed, for example, 75 mm/sec. As stated above, the width of the temperature variation becomes large, and there is a possibility that it exceeds the allowable range.

The second embodiment of the invention is the mode of the temperature control to reduce the width of the temperature variation even in the case where the movement speed of the fixing belt 14 is changed from normal speed to low speed.

Figure 8:
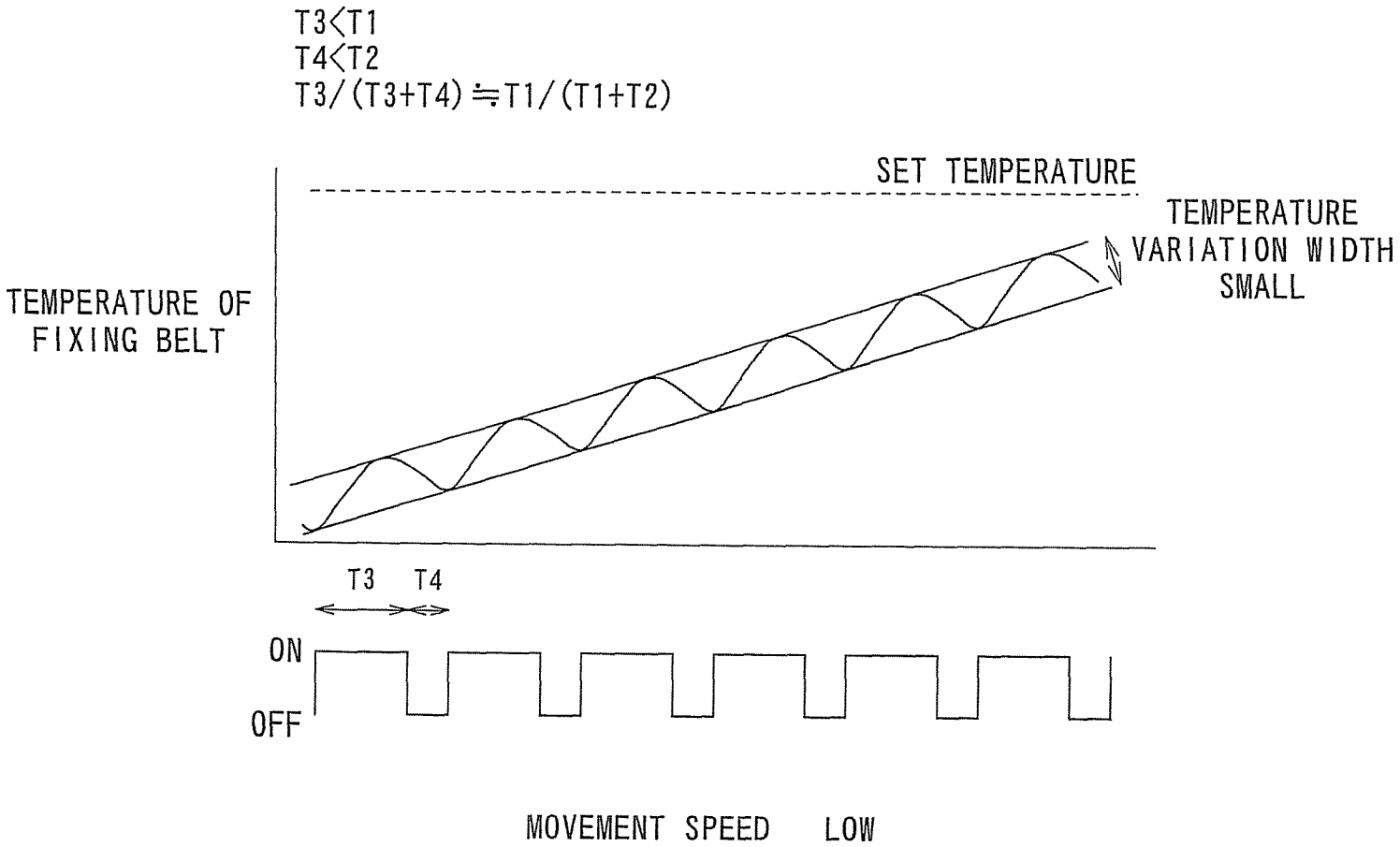
FIG. 8 is a view showing a state of a temperature variation at a time when a temperature control method of a second embodiment is used.

Specifically, as shown in FIG. 8, the periods T1 and T2 are set to be periods T3 and T4 smaller than the set values of normal speed. By setting the periods T3 and T4 to the small values, the time of heat reception and the time of heat radiation become small, and therefore, there is an effect that the width of the temperature variation is reduced.

For example, when the normal movement speed is V1, and the low speed is V2 (V1>V2), $$T3+T4=(T1+T2)\cdot(V2/V1). \quad \text{(expression 1)}$$

On the other hand, it is assumed that the on-duty ratio is constant irrespective of the movement speed. That is, $$T3/(T3+T4)=T1/(T1+T2) \quad \text{(expression 2)}$$

In the foregoing example, since the speeds are V1=150 mm/sec and V2=75 mm/sec, the periods become T3=T1/2=1.7 seconds and T4=T2/2=0.8 seconds.

According to the new periods T3 and T4 obtained by the (expression 1) and (expression 2), the width of the temperature variation can be reduced, and further, since the on-duty ratio is constant, there is a merit that the electric power consumption does not change.

The uneven temperature on the recording sheet at the time of fixation is influenced by not only the change of the movement speed of the fixing belt 14, but also the paper quality of the recording sheet and use environment.

Then, the mode may be made such that the operator actually confirms the state of the recording sheet after fixation, and according to the result, the operator can input and change a period T3' and a period T4' by the operation unit 8 such as an operation panel or keys. In this mode, since the state of the uneven temperature of the actual recording sheet can be grasped, a finer adjustment becomes possible.

As described above, according to the fixing apparatus of the embodiment, the image forming apparatus including, the fixing apparatus, and the fixing method, the variation in electric power consumption is suppressed, the equalization of temperature of the fixing belt can be ensured not only in the axial direction of the heating roller but also in the movement direction of the fixing belt, and the uniform fixation without uneven temperature can be performed to the recording sheet.

Incidentally, the invention is not limited to the embodiments as described, but can be embodied at a practical stage while structural elements are modified within the range not departing from the gist. Besides, various inventions can be formed by suitable combinations of plural structural elements disclosed in the embodiments. For example, some structural elements may be deleted from all the structural elements disclosed in the embodiment. Further, structural elements of different embodiments may be suitably combined.

What is claimed is:

1. A fixing apparatus, comprising:

a heating roller having a center part and a peripheral part;

a first heater included in the heating roller, heating the center part of the heating roller;

a second heater included in the heating roller, heating the peripheral part of the heating roller;

a fixing roller;

a fixing belt heated by the heating roller, wound around the heating roller and the fixing roller, and circulating between the heating roller and the fixing roller;

a pressing roller pressing the fixing roller through the fixing belt;

a first non-contact sensor spaced from the fixing belt, detecting a temperature of a first surface area of the fixing belt, the first surface area corresponding to the center part of the heating roller;

a second non-contact sensor spaced from the fixing belt, detecting a temperature of a second surface area of the fixing belt, the second surface area corresponding to the peripheral part of the heating roller; and a temperature control unit configured to:

control a temperature of the heating by an on/off control of the first heater and the second heater based on a first temperature detected by the first non-contact sensor and a second temperature detected by the second non-contact sensor, the temperature control unit performing the on/off control in which when one of the first heater and the second heater is turned on, the other is off, and to further control the temperature of the heating such that a sum of an on and an off time of at least one of the first or second heater is set to a first repetition period when a speed of the fixing belt is set to a first speed, and the sum of the on and off time is set to a second repetition period shorter than the first repetition period when the speed of the fixing belt is set to a second speed lower than the first speed.

2. The fixing apparatus of claim 1, wherein the first and second non-contact sensors are non-contact type thermistors.

3. The fixing apparatus of claim 1, wherein each of the first and second non-contact sensors has a set temperature equal to each other.

4. The fixing apparatus of claim 3, wherein (1) in a case where both the temperatures detected by the first and second non-contact sensors are lower than the set temperature, the temperature control unit performs the on/off control which is repeated at a cycle of a sum of a first period and a second period shorter than the first period, and in this case, (a) in a case where the temperature detected by the first non-contact sensor is lower than the temperature detected by the second non-contact sensor, the first heater is turned on in the first period, and the second heater is turned on in the second period, (b) in a case where the temperature detected by the second non-contact sensor is lower than the temperature detected by the first non-contact sensor, the second heater is turned on in the first period, and the first heater is turned on in the second period, (2) in a case where the temperature detected by the first non-contact sensor is lower than the set temperature, and the temperature detected by the second non-contact sensor is equal to or higher than the set temperature, the first heater is turned on, and the second heater is turned off, (3) in a case where the temperature detected by the second non-contact sensor is lower than the set temperature, and the temperature detected by the first non-contact sensor is equal to or higher than the set temperature, the second heater is turned on, and the first heater is turned off, and (4) in a case where both the temperatures detected by the first and second non-contact sensors are equal to or higher than the set temperature, both the first and the second heaters are turned off.

5. The fixing apparatus according to claim 4, wherein in a case where a movement speed of the fixing belt is changed, a ratio of the first period to the second period is made constant, and the temperature control unit sets the cycle to become short in a case where the movement speed is changed in a direction in which it becomes low, and the temperature control unit sets the cycle to become long in a case where the movement speed is changed in a direction in which it becomes high.

6. The fixing apparatus of claim 4, wherein the first period and the second period are set to be changeable.

7. The fixing apparatus of claim 1, wherein a running direction of a paper which is pressed by the paper pressing roller and the fixing roller is substantially vertical.

8. An image forming apparatus comprising a fixing apparatus to perform a temperature control by using a heater wherein the fixing apparatus comprises:

a heating roller having a center part and a peripheral part;

a first heater included in the heating roller heating the center part of the heating roller;

a second heater included in the heating roller, heating the peripheral part of the heating roller;

a fixing roller;

a fixing belt heated by the heating roller wound around the heating roller and the fixing roller, and circulating between the heating roller and the fixing roller;

a pressing roller pressing the fixing roller through the fixing belt;

a first non-contact sensor spaced from the fixing belt detecting a temperature of a first surface area of the fixing belt the first surface area corresponding to the center part of the heating roller;

a second non-contact sensor spaced from the fixing belt detecting a temperature of a second surface area of the fixing belt, the second surface area corresponding to the peripheral part of the heating roller; and a temperature control unit configured to:

control a temperature of the heating by an on/off control of the first heater and the second heater based on a first temperature detected by the first non-contact sensor and a second temperature detected by the second non-contact sensor, the temperature control unit performing the on/off control in which when one of the first heater and the second heater is turned on, the other is off, and to further control the temperature of the heating such that a sum of an on and an off time of at least one of the first or second heater is set to a first repetition period when a speed of the fixing belt is set to a first speed, and the sum of the on and off time is set to a second repetition period shorter than the first repetition period when the speed of the fixing belt is set to a second speed lower than the first speed.

9. The image forming apparatus of claim 8, wherein the first and second non-contact sensors are non-contact type thermistors.

10. The image forming apparatus of claim 8, wherein each of the first and second non-contact sensors has a set temperature equal to each other.

11. The image forming apparatus of claim 10, wherein (1) in a case where both the temperatures detected by the first and second non-contact sensors are lower than the set temperature, the temperature control unit performs the on/off control which is repeated at a cycle of a sum of a first period and a second period shorter than the first period, and in this case, (a) in a case where the temperature detected by the first non-contact sensor is lower than the temperature detected by the second non-contact sensor, the first heater is turned on in the first period, and the second heater is turned on in the second period, (b) in a case where the temperature detected by the second non-contact sensor is lower the second heater is turned on in the first period, and the first heater is turned on in the second period, (2) in a case where the temperature detected by the first non-contact sensor is lower than the set temperature, and the temperature detected by the second non-contact sensor is equal to or higher than the set temperature, the first heater is turned on, and the second heater is turned off, (3) in a case where the temperature detected by the second non-contact sensor is lower than the set temperature, and the temperature detected by the first non-contact sensor is equal to or higher than the set temperature, the second heater is turned on, and the first heater is turned off, and (4) in a case where both the temperatures detected by the first and second non-contact sensors are equal to or higher than the set temperature, both the first and the second heaters are turned off.

12. The image forming apparatus according to claim 11, wherein in a case where a movement speed of the fixing belt is changed, a ratio of the first period to the second period is made constant, and the temperature control unit sets the cycle to become short in a case where the movement speed is changed in a direction in which it becomes low, and the temperature control unit sets the cycle to become long in a case where the movement speed is changed in a direction in which it becomes high.

13. The image forming apparatus of claim 11, wherein the first period and the second period are set to be changeable.

14. The image forming apparatus of claim 8, wherein a running direction of a paper which is pressed by the paper pressing roller and the fixing roller is substantially vertical.

15. A fixing method comprising:

heating a center part of a heating roller by a first heater included in the heating roller; heating a peripheral part of the heating roller by a second heater included in the heating roller;

heating a fixing belt by the heating roller, the fixing belt being wound around the heating roller and a fixing roller, and circulating between the heating roller and the fixing roller;

pressing a pressing roller against the fixing roller through the fixing belt;

detecting a temperature of a first surface area of the fixing belt by a first non-contact sensor spaced from the fixing belt, the first surface area corresponding to the center part of the heating roller;

detecting a temperature of a second surface area of the fixing belt by a second non-contact sensor spaced from the fixing belt, the second surface area corresponding to the peripheral part of the heating roller;

controlling a temperature of the heating by an on/off control of the first heater and the second heater based on a first temperature detected by the first non-contact sensor and a second temperature detected by the second non-contact sensor, while performing the on/off control in which when one of the first heater and the second heater is turned on, the other is off, and further controlling the temperature of the heating such that a sum of an on and an off time of at least one of the first or second heater is set to a first repetition period when a speed of the fixing belt is set to a first speed, and the sum of the on and off time is set to a second repetition period shorter than the first repetition period when the speed of the fixing belt is set to a second speed lower than the first speed.

16. The fixing method of claim 15, wherein the first and second non-contact sensors are non-contact type thermistors.

17. The fixing method of claim 15, wherein each of the first and second non-contact sensors has a set temperature equal to each other.

18. The fixing method of claim 17, wherein (1) in a case where both the temperatures detected by the first and second non-contact sensors are lower than the set temperature, the on/off control which is repeated at a cycle of a sum of a first period and a second period shorter than the first period is performed, and in this case, (a) in a case where the temperature detected by the first non-contact sensor is lower than the temperature detected by the second non-contact sensor, the first heater is turned on in the first period, and the second heater is turned on in the second period, (b) in a case where the temperature detected by the second non-contact sensor is lower than the temperature detected by the first non-contact sensor, the second heater is turned on in the first period, and the first heater is turned on in the second period, (2) in a case where the temperature detected by the first non-contact sensor is lower than the set temperature, and the temperature detected by the second non-contact sensor is equal to or higher than the set temperature, the first heater is turned on, and the second heater is turned off, (3) in a case where the temperature detected by the second non-contact sensor is lower than the set temperature, and the temperature detected by the first non-contact sensor is equal to or higher than the set temperature, the second heater is turned on, and the first heater is turned off, and (4) in a case where both the temperatures detected by the first and second non-contact sensors are equal to or higher than the set temperature, both the first and the second heaters are turned off.

19. The fixing apparatus according to claim 18, wherein in a case where a movement speed of the fixing belt is changed, a ratio of the first period to the second period is made constant, the cycle is set to become short in a case where the movement speed is changed in a direction in which it becomes low, and the cycle is set to become long in a case where the movement speed is changed in a direction in which it becomes high.

20. The fixing apparatus of claim 18, wherein the first period and the second period are set to be changeable.

* * * * *